US011162252B2

(12) United States Patent
Park

(10) Patent No.: US 11,162,252 B2
(45) Date of Patent: Nov. 2, 2021

(54) TOILET BOWL WITH CLOG REMOVAL FUNCTION

(71) Applicant: Kyeo Reh Park, Seoul (KR)

(72) Inventor: Kyeo Reh Park, Seoul (KR)

( * ) Notice: Subject to any disclaimer, the term of this patent is extended or adjusted under 35 U.S.C. 154(b) by 0 days.

(21) Appl. No.: 17/326,338

(22) Filed: May 21, 2021

(65) Prior Publication Data

US 2021/0277645 A1 Sep. 9, 2021

Related U.S. Application Data

(63) Continuation of application No. PCT/KR2020/005597, filed on Apr. 28, 2020.

(30) Foreign Application Priority Data

Apr. 30, 2019 (KR) ..... 10-2019-0051066
May 31, 2019 (KR) ..... 10-2019-0064416

(51) Int. Cl.
*E03D 11/13* (2006.01)

(52) U.S. Cl.
CPC ..... *E03D 11/13* (2013.01)

(58) Field of Classification Search
CPC ..... E03D 11/13; E03D 9/00; E03D 9/002; E03D 9/04; E03C 1/30; E03C 1/304; E03C 1/308
USPC ..... 4/255.01–255.12, 420
See application file for complete search history.

(56) References Cited

U.S. PATENT DOCUMENTS 5,249,311 A * 10/1993 Rau ..... E03C 1/306 15/406
5,600,856 A * 2/1997 Kang ..... E03D 9/00 4/255.01
5,768,719 A * 6/1998 Harvey ..... E03D 9/00 4/255.01
6,804,838 B2 * 10/2004 Lacus ..... E03D 9/00 4/255.01
8,104,102 B2 * 1/2012 O'Hanley ..... E03D 9/00 4/255.01
8,418,275 B1 * 4/2013 Dondurur ..... E03D 9/00 4/255.04

(Continued)

FOREIGN PATENT DOCUMENTS

KR 200451021 B1 11/2010
KR 200451021 Y1 * 11/2010

(Continued)

OTHER PUBLICATIONS

KR-101430735-B1 Machine Translation (Year: 2021).*
KR-200451021-Y1 (Year: 2021).*

*Primary Examiner* — David P Angwin
*Assistant Examiner* — William R Klotz
(74) *Attorney, Agent, or Firm* — Nicholas Park

(57) ABSTRACT

Provided is a toilet clog removal device installed in a toilet bowl. The toilet clog removal device comprises cartridge provided in an upper portion of a toilet body and configured to generate or store gas with pressure; a toilet cover hinged to the cartridge and configured to open and close above a toilet seat and the toilet body. The cartridge stores a compound for generating the gas with pressure inside and, when the compound decomposes by igniting an igniter, the gas with pressure is generated and discharged from the cartridge.

8 Claims, 14 Drawing Sheets

(56) References Cited

U.S. PATENT DOCUMENTS

| | | | | |
|---|---|---|---|---|
| 8,776,281 | B2 * | 7/2014 | Dondurur | E03D 9/00 4/255.04 |
| 2013/0198943 | A1 * | 8/2013 | Park | E03D 9/00 4/255.04 |
| 2015/0074889 | A1 * | 3/2015 | Donohue | E03C 1/304 4/255.06 |

FOREIGN PATENT DOCUMENTS

| | | | |
|---|---|---|---|
| KR | 2020110001619 | A | 2/2011 |
| KR | 101430735 | B1 * | 8/2014 |

* cited by examiner

TOILET BOWL WITH CLOG REMOVAL FUNCTION

CROSS-REFERENCE TO RELATED APPLICATION

This application is a US Bypass Continuation Application of International Application No. PCT/KR2020/005597, filed on Apr. 28, 2020 and designating the United States, the International Application claiming a priority date of Apr. 30, 2019, based on prior Korean Patent Application No. 10-2019-0051066, filed on Apr. 30, 2019, and claiming a priority based on prior Korean Patent Application No. 10-2019-0064416, filed on May 31, 2021. The disclosure of which is incorporated herein by reference in its entirety.

BACKGROUND

1. Field

The present disclosure of the following description relates to a toilet bowl with a clog removal function.

2. Related Art

In general, a toilet bowl is installed to dispose of dirt. The toilet bowl includes a body in a shape of which an upper portion is open and of which a central portion is recessed, a water tank provided at the rear of the body and configured to store water for discharging foreign substances in a toilet to a septic tank, a toilet seat rotatably hinged to the body, and a toilet cover.

Therefore, a user may use the toilet bowl by sitting on the toilet seat after flipping back the toilet cover that covers an opening of the body. Here, if the user operates a flushing lever mounted on one side of the water tank after use, the water stored in the water tank may be supplied to an inside of the body and discharge foreign substances to the septic tank.

When the user operates a lever or a button after toileting, the stored water may flow into the body and dirt or feces may be discharged through a sewer connected to the water storage space of the toilet body.

However, when feces or foreign substances block the sewer, even the discharging water may not discharge dirt or feces through the sewer. This situation may cause the user to feel serious discomfort. In addition, water or dirt may overflow outside an opening of the toilet body, which may cause a serious hygienic issue.

Typically, in a home, a hand-operated compressor made of a rubber material or a dissolving agent capable of dissolving foreign substances clogging the sewer may be used. However, in many cases, clogging of the sewer may not be resolved since foreign substances are not effectively dissolved by the dissolving agent. Also, if the user is not familiar with the use of the hand-operated compressor, clogging of the sewer may not be removed.

Although clogging of the sewer is removed through the hand-operated compressor, the user needs to perform a pumping operation directly and thus may feel a considerable discomfort in a working process.

SUMMARY

At least one example embodiment is to effectively remove clogging of a toilet bowl and to minimize intervention of a user during a resolving process.

A characteristic composition of the disclosure to achieve the aforementioned objects and the following characteristic effect may follow as:

According to an aspect, there is provided A toilet clog removal device installed in a toilet bowl, the toilet clog removal device comprising: cartridge provided in an upper portion of a toilet body and configured to generate or store gas with pressure; an outlet configured to allow the gas with pressure generated or stored in the cartridge to be discharged into a water storage space of the toilet body; and a toilet cover hinged to the cartridge and configured to open and close above a toilet seat and the toilet body, wherein the toilet cover is configured to seal the water storage space, the cartridge stores a compound for generating the gas with pressure inside and, when the compound decomposes by igniting an igniter, the gas with pressure is generated and discharged from the cartridge.

The toilet cover is configured to protrude from an edge and a sucker configured to attach to the edge of the toilet cover, the sucker allows the water storage space to be sealed when the toilet cover is closed and pressed against an upper edge of the toilet body.

A circumferential length of the lateral wall of the toilet cover is greater than that of a toilet seat.

The toilet clog removal device further comprises a flexible tube configured to connect at an end of the outlet and of which volume varies based on an amount of gas with pressure discharged from the nozzle.

The toilet clog removal device further comprises an gas intake configured to increase a pressing force between the sucker and the upper edge of the toilet body by inhaling the gas inside the sucker through a suction pipe that communicates with the inside of the sucker.

The cartridge stores sodium azide inside and, when the compound decomposes by igniting an igniter, the gas with pressure is generated and discharged from the cartridge.

According to another aspect, there is provided a toilet bowl comprising: a toilet body having a water storage space of which an upper portion is open and of which a central portion is recessed to accommodate water; a water storage tank configured to supply water to the toilet body; a toilet seat rotatably hinged to an upper portion of the toilet body; a cartridge provided between the toilet body and the water storage tank and configured to generate or store gas with pressure; a nozzle configured to allow the gas with pressure stored in the cartridge to be discharged into the water storage space of the toilet body; and a toilet cover hinged to the cartridge and configured to open and close above the toilet seat and the toilet body, wherein the toilet cover is configured to seal the water storage space, the cartridge stores a compound for generating the gas with pressure inside and, when the compound decomposes by igniting an igniter, the gas with pressure is generated and discharged from the cartridge.

The toilet bowl further comprises a bidet configured to couple with the upper portion of the toilet body, wherein the cartridge is built in the bidet and the nozzle is built in an outlet of the bidet.

Further areas of applicability will become apparent from the description provided herein. The description and specific examples in this summary are intended for purposes of illustration only and are not intended to limit the scope of the present disclosure.

BRIEF DESCRIPTION OF THE FIGURES

The accompanying drawings used to explain example embodiments are only a portion of the example embodiments and other drawings may be obtained based on these drawings for those of ordinary skill in the art to which the disclosure pertains (hereinafter, "those skilled in the art") without an effort to reach the disclosure.

DETAILED DESCRIPTION

Figure 1:
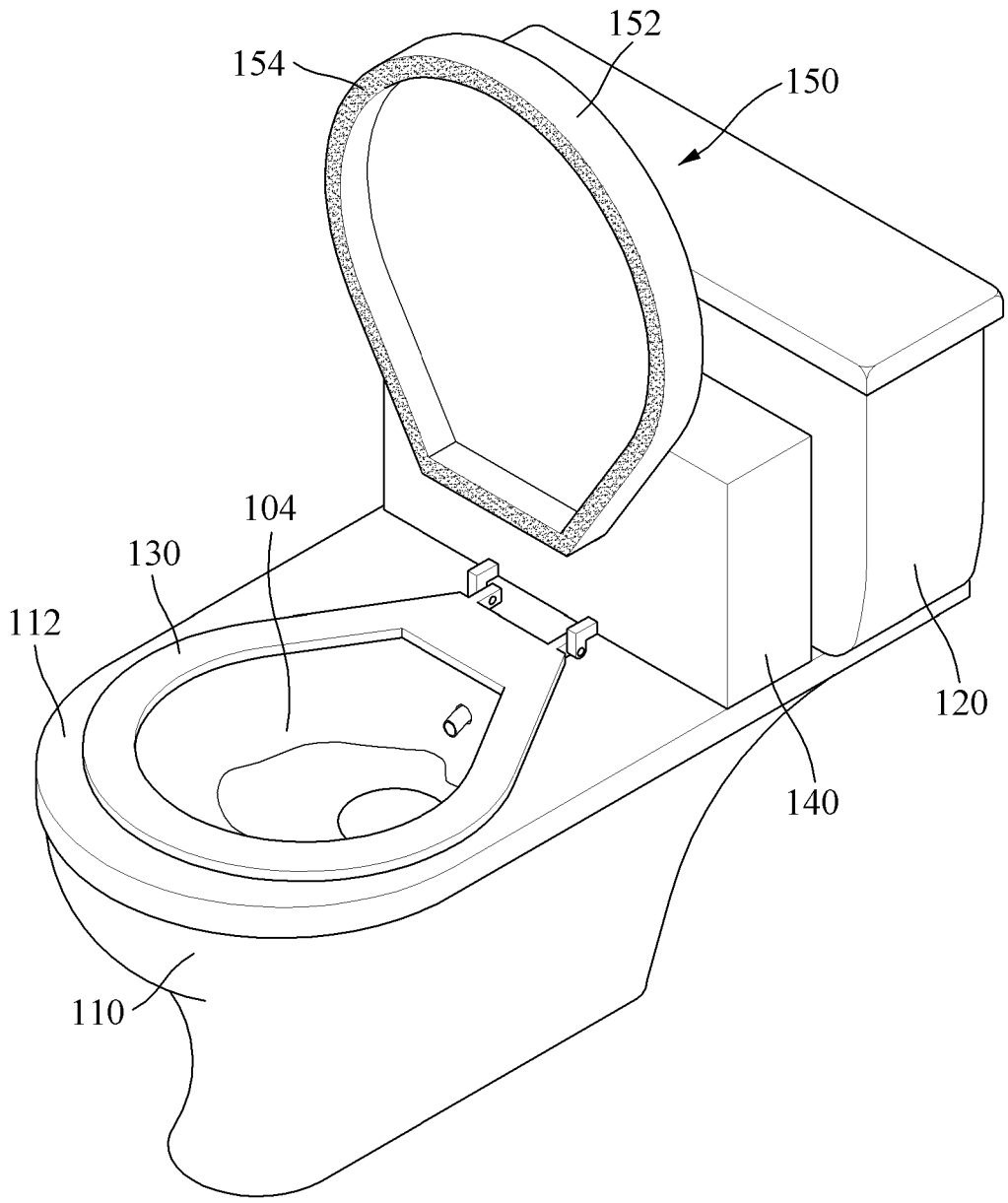
FIG. 1 is a perspective view illustrating an example of a toilet bowl according to an example embodiment.

The following detailed description refers to the accompanying drawings illustrating specific example embodiments in which the present disclosure may be practiced, to clarify the objects, technical solutions, and advantages of the disclosure. The example embodiments are described in detail sufficient for those skilled in the art to carry out the disclosure.

It will be further understood that the terms "comprises/comprising (incudes/including)," and "has/having" when used in this specification, specify the presence of stated features, integers, steps, operations, elements, and/or components, but do not preclude the presence or addition of one or more other features, integers, steps, operations, elements, components, and/or groups, thereof. When a component is referred to as being "connected to" or "coupled to" another component, the component may be directly connected to or coupled to the other component, or one or more other intervening components may be present. In contrast, when a component is referred to as being "directly connected to" or "directly coupled to," there is no intervening component. Other representations describing a relation between components, for example, "between~" and "just between~" or "neighboring to~" and "directly neighboring to~" should be interpreted in the same manner.

Although the terms "first," "second," etc., may be used herein to describe various components, the components should not be limited by these terms. These terms are only used to distinguish one component from another component. For example, a first component may also be termed a second component and, likewise, a second component may be termed a first component, without departing from the scope of this disclosure.

Meanwhile, the term "water" used herein is used as a term that refers to water used for washing purposes, for example, washing water. However, those skilled in the art should understand that the water may include various types of liquids.

It will be apparent to those skilled in the art that a portion of other purposes, advantages, and features of the disclosure may be from this description and another portion thereof may be from implementations of the disclosure. The following examples and drawings are provided as examples and are not intended to limit the disclosure. Further, the present disclosure covers all possible example embodiments disclosed herein. Although various example embodiments differ from each other, it should be understood that they do not need to be mutually exclusive. For example, specific shapes, structures, and features described herein may be implemented in other example embodiments without departing from the spirit and the scope of the disclosure in relation to an example embodiment. Also, it should be understood that a position or an arrangement of an individual component in each disclosed example embodiment may be modified without departing from the spirit and scope of the disclosure. Therefore, the following detailed description is not construed as limiting and the scope of the disclosure, if properly described, is limited only by the appended claims and the equivalents thereof. In the drawings, like reference numerals refer to like elements throughout.

The singular forms "a," "an," and "the," are intended to include the plural forms as well, unless the context clearly indicates otherwise. Also, when detailed description related to a related known configuration or function is determined to make the subject matter of the present disclosure ambiguous in describing the example embodiment, the detailed description will be omitted.

Hereinafter, for those skilled in the art to readily implement the present disclosure, the example embodiments are described with reference to the accompanying drawings.

FIG. 1 is a perspective view illustrating an example of a toilet bowl according to an example embodiment. Referring to FIG. 1, the toilet bowl may include a toilet body 110 having a water storage space 104 of which an upper portion is open and of which a central portion is recessed to accommodate water, a water storage tank 120 configured to supply water to the toilet body 110, and a toilet seat 130 rotatably hinged to an upper portion of the toilet body 110.

The toilet bowl may include a cartridge 140 provided between the toilet body 130 and the water storage tank 120 in the upper portion of the toilet body 110. The gas with pressure stored in the cartridge 140 may be discharged into the water storage space 104 of the toilet body 110 through a nozzle 144, which is described below. The nozzle 144 may be fastened to an upper portion of the water storage space 104. By providing the nozzle 144 to be fastened to the upper portion of the water storage space 104, the nozzle 144 may be prevented from flooding immediately even when a water level rises due to clogging of a toilet.

The cartridge 140 may generate or store the gas with pressure. For example, the cartridge 140 may contain pre-generated gas inside. As another example, sodium azide ($NaN_3$) may be stored in the cartridge 140. When a user performs a control operation, such as, for example, controlling a button, the cartridge 140 may supply active energy to the internally stored sodium azide by operating an igniter. Here, sodium azide may be decomposed into sodium and nitride gases. During this process, a large amount of nitrogen gas may be generated instantaneously and the generated nitrogen gas may flow into the water storage tank 120 of the toilet body 110 at a relatively high pressure. A process of generating the nitrogen gas from sodium azide may be represented as the following Formula 1.

$$2NaN_3(s) \rightarrow 2Na(s) + 3N_2(g) \quad \text{[Formula 1]}$$

The cartridge 140 may further include iron oxide therein. Sodium generated from Formula 1 may be converted to sodium oxide through reaction to the iron oxide. Since sodium oxide is a more metallic compound than metallic oxide, stability of the cartridge 140 may be improved. A process of generating sodium oxide may be represented as Formula 2.

$$6Na(s)+Fe_2O_3(s)\rightarrow 3Na_2O_3(s)+2Fe(s) \quad \text{[Formula 2]}$$

The toilet bowl may include a toilet cover 150 rotatably hinged to the cartridge 140. The toilet cover 150 may include a lateral surface configured to protrude from an edge and a sucker 154 configured to attach to a bottom of the lateral surface 152. The sucker 154 may be made of a rubber material. An upper portion of the toilet seat 130 and the toilet body 110 may be opened and closed through rotation of the toilet cover 150. For example, when the toilet cover 150 is lowered, the toilet seat 130 may be inserted into an internal space formed in the lateral surface 152 of the toilet cover 150. Also, the sucker 154 of the toilet cover 150 may be pressed against an upper edge 112 of the toilet body 110. The water storage space 104 may be sealed in such a manner that the sucker 154 is pressed against the upper edge 112 of the toilet body 110. When the gas with pressure is discharged into the water storage space 104 in a state in which the water storage space 104 is sealed, pressure of the water storage space 104 may increase.

Figure 2:
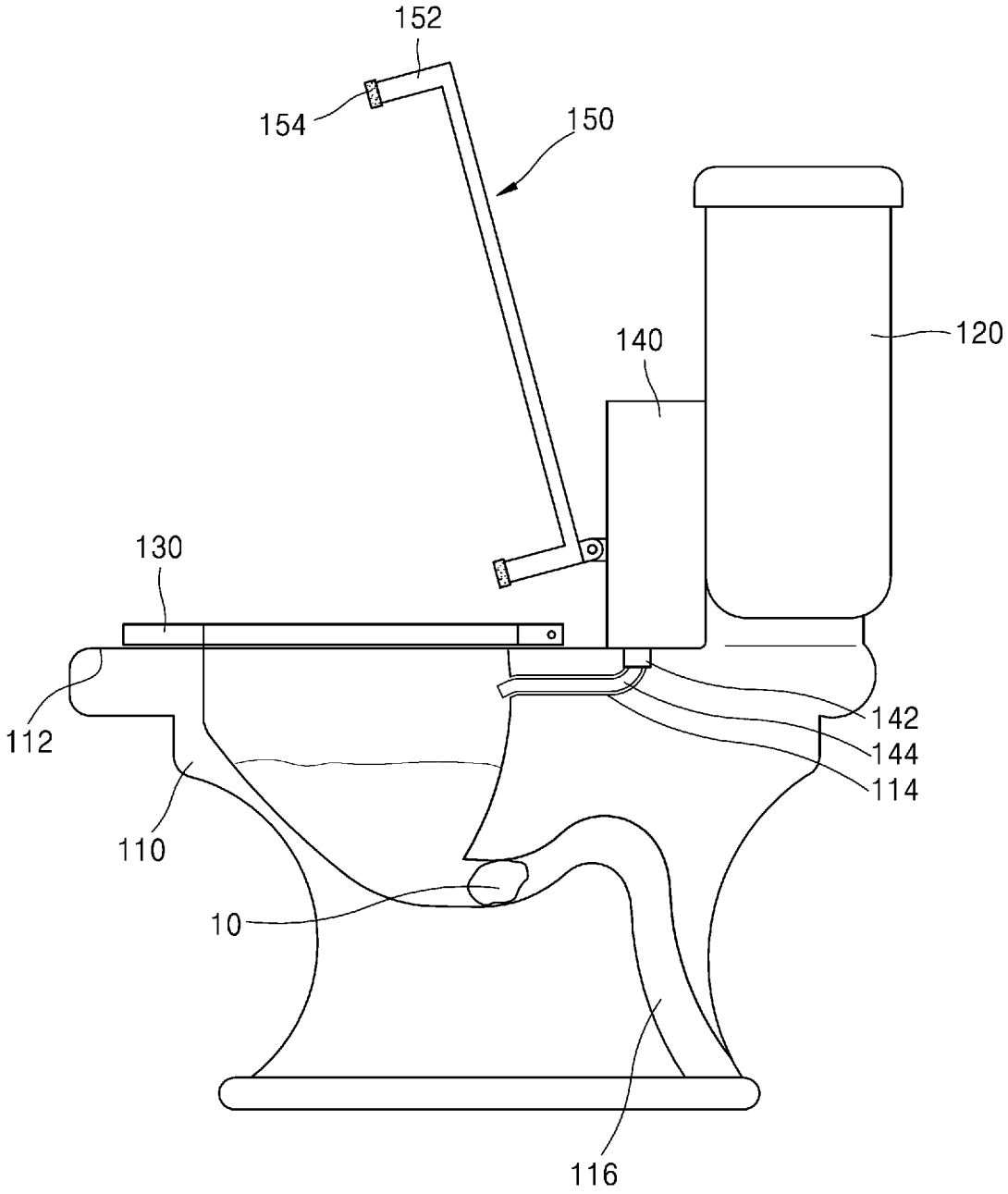
FIGS. 2 and 3 are cross-sectional views illustrating a toilet bowl according to a first example embodiment.
Figure 3:
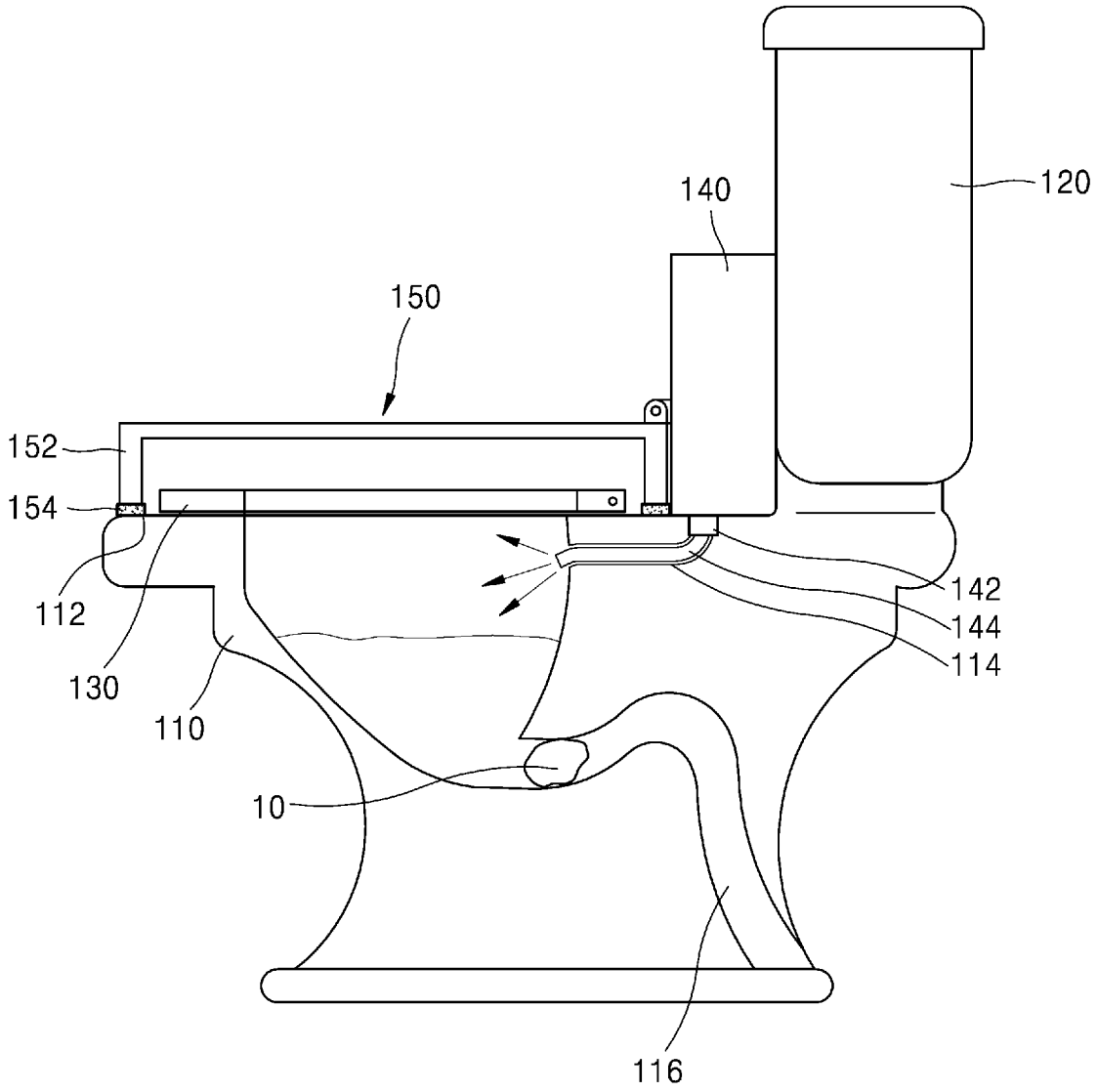

FIGS. 2 and 3 are cross-sectional views illustrating a toilet bowl according to a first example embodiment. In FIGS. 2 and 3, other general components includable in a toilet are omitted in addition to components related to description of the example embodiment.

Referring to FIGS. 2 and 3, when a foreign substance 10 is caught in a drainage channel 116 of the toilet bowl and the drainage channel 116 is blocked, water and dirt stored in the water storage tank 114 may not be discharged through the drainage channel 116. When the toilet cover 150 is tilted upward, the upper portion of the toilet body 110 may be opened. A top surface of the toilet cover 150 may be supported by the lateral surface 152. Therefore, the upper portion of the toilet seat 130 and the toilet body 110 may be sealed together by the toilet cover 150. Referring to FIG. 3, when the toilet cover 150 is lowered by rotation, the sucker 154 provided below the lateral surface 152 of the toilet cover 150 may be pressed against the upper edge 112 of the toilet body 110.

A circumferential length of the lateral surface 152 may be greater than that of the toilet seat 130. Therefore, when the toilet cover 150 is closed, the toilet seat 130 may be present in a space provided in the lateral surface 152 of the toilet cover 150. The entire area that includes the toilet seat 130 may be sealed by the toilet cover 150.

When the sucker 154 is pressed against the upper edge 112 of the toilet body 110, the water storage tank 120 of the toilet body 110 may be sealed. When a control instruction is transferred through a button manipulation of the user, the cartridge 140 may discharge the gas with pressure through the nozzle 144. The nozzle 144 may insert into a through hole 114 provided in the toilet body 110. In response to the control instruction, the cartridge 140 may open a valve 142 and may discharge the pre-stored gas with pressure through the nozzle 144. As another example, the cartridge 140 may decompose sodium azide by operating the igniter in response to the control instruction and may discharge nitrogen gas being generated, through the nozzle 144. In this case, the valve 142 may be omitted.

When the gas with pressure is discharged through the nozzle 144, the pressure inside the water storage tank 120 of the toilet body 110 may increase. The increased pressure may generate a force of pushing the water stored in the water storage tank 120 into the drainage channel 116. Clogging of the drainage channel 116 may be removed as the foreign substance 10 present in the drainage channel 116 is pushed out by this pushing force.

Figure 4:
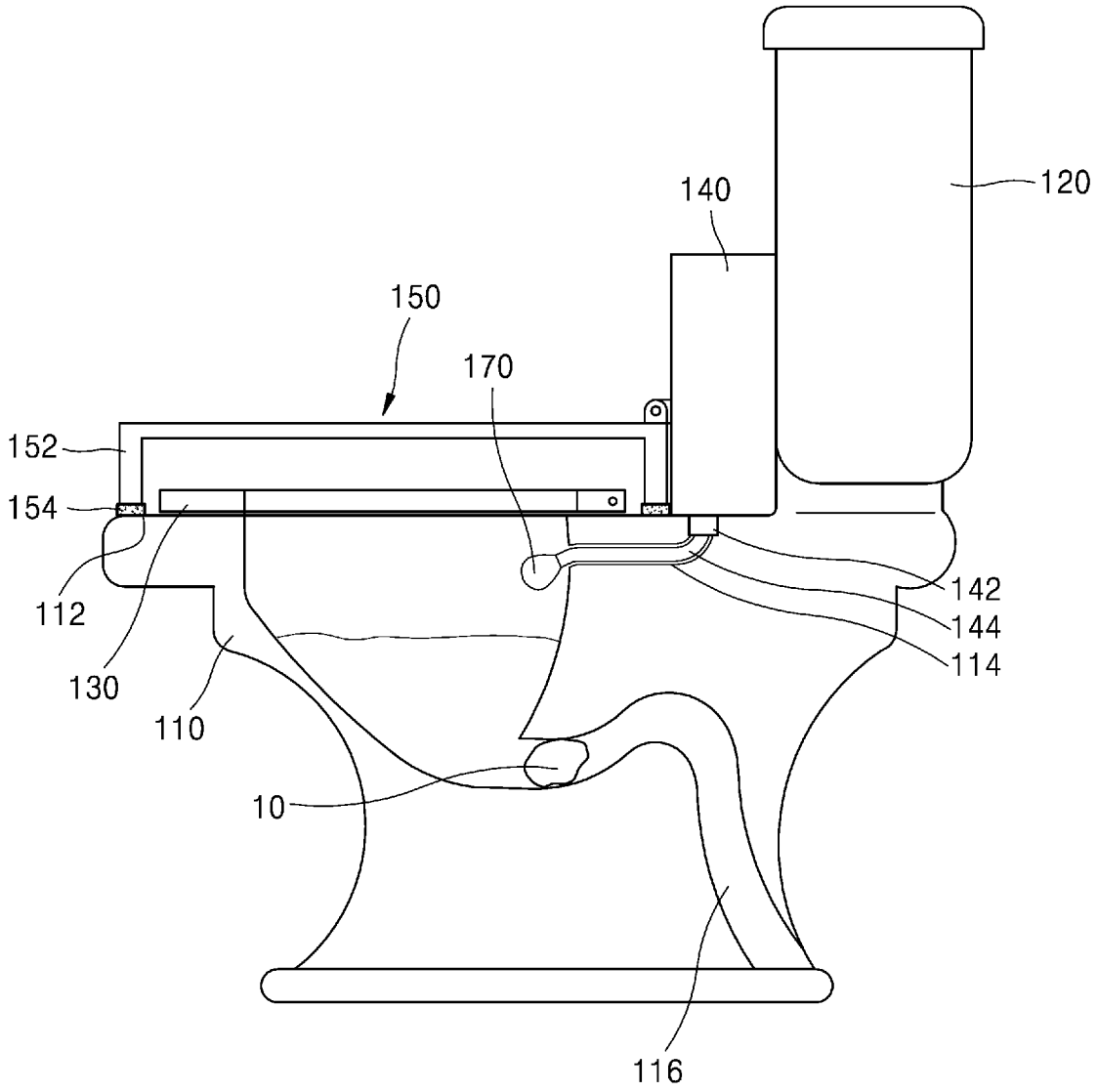
FIGS. 4 and 5 are cross-sectional views illustrating a toilet bowl according to a second example embodiment.
Figure 5:
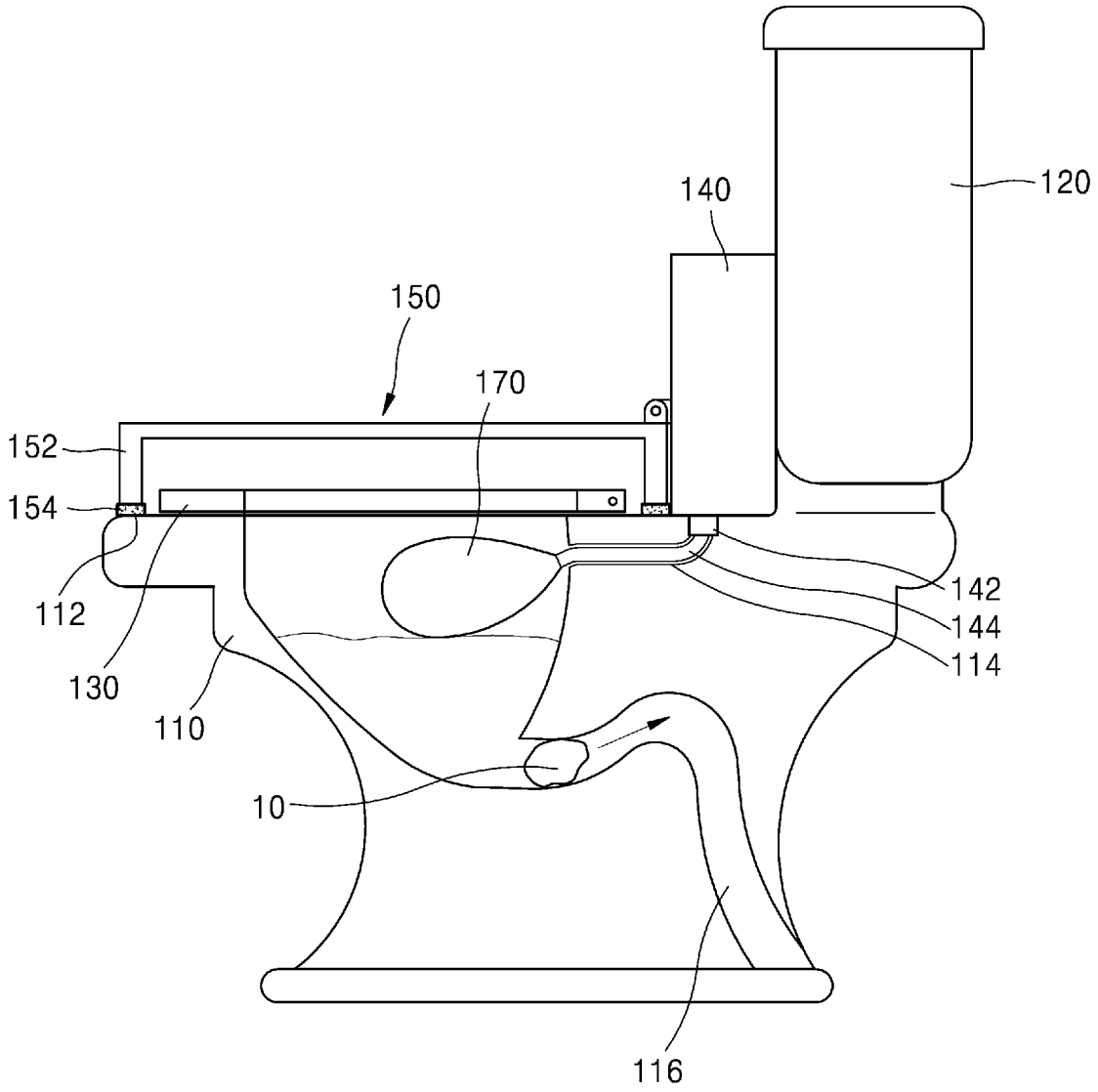

FIGS. 4 and 5 are cross-sectional views illustrating a toilet bowl according to a second example embodiment. In describing the example embodiment of FIGS. 4 and 5, content overlapping with that of FIGS. 2 and 3 is omitted.

Referring to FIGS. 4 and 5, the toilet bowl may further include a flexible tube 170 configured to connect at an end of the nozzle 144. Volume of the flexible tube 170 may vary based on an amount of air or pressure inside the flexible tube 170. To this end, the flexible tube 170 may be made of a rubber or other flexible materials. When the cartridge 140 discharges the gas with pressure through the nozzle 144, the discharged gas with pressure may increase the volume of the flexible tube 170. When the volume of the flexible tube 170 increases in a state in which the water storage tank 120 is sealed by the toilet cover 150, the pressure of the water storage tank 120 may increase. The increased pressure may generate a force of pushing water stored in the water storage tank 120 into the drainage channel 116. Clogging of the drainage channel 116 may be removed as the foreign substance 10 present in the drainage channel 116 is pushed out by this pushing force.

Referring to FIGS. 4 and 5, it is possible to prevent splashing occurring due to a friction between the gas with pressure discharged in a process of discharging the gas with pressure into the water storage tank 120 and the water stored in the water storage tank 120. That is, since the air discharged under strong pressure does not cause a direct friction with the water, it is possible to prevent a phenomenon that the water containing dirt splashes in all directions in a sealed space. Also, the increase in the volume of the flexible tube 170 may gradually increase the pressure inside the water storage tank 120, thereby effectively removing clogging.

Figure 6:
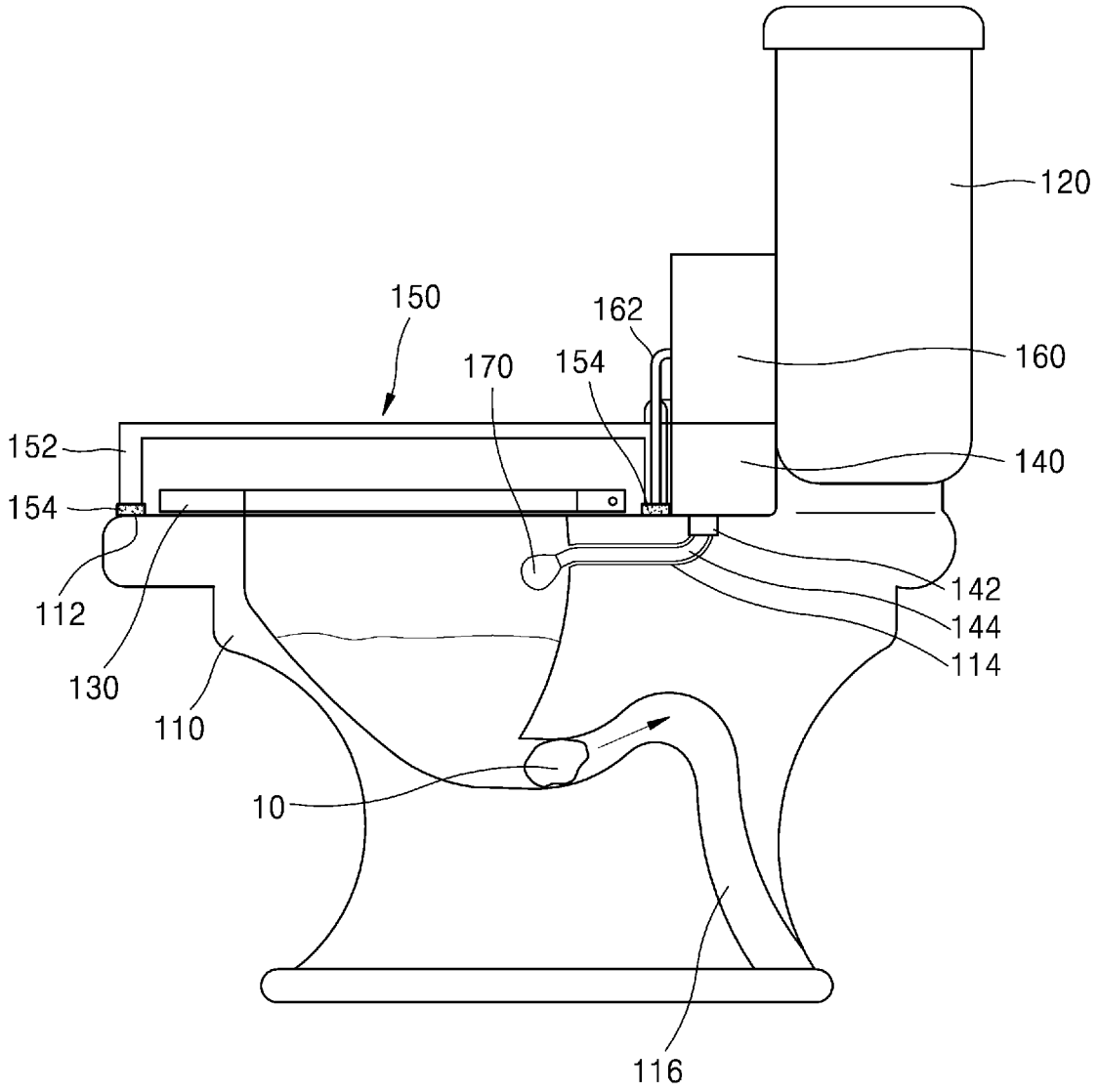
FIGS. 6 and 7 are cross-sectional views illustrating a toilet bowl according to a third example embodiment.
Figure 7:
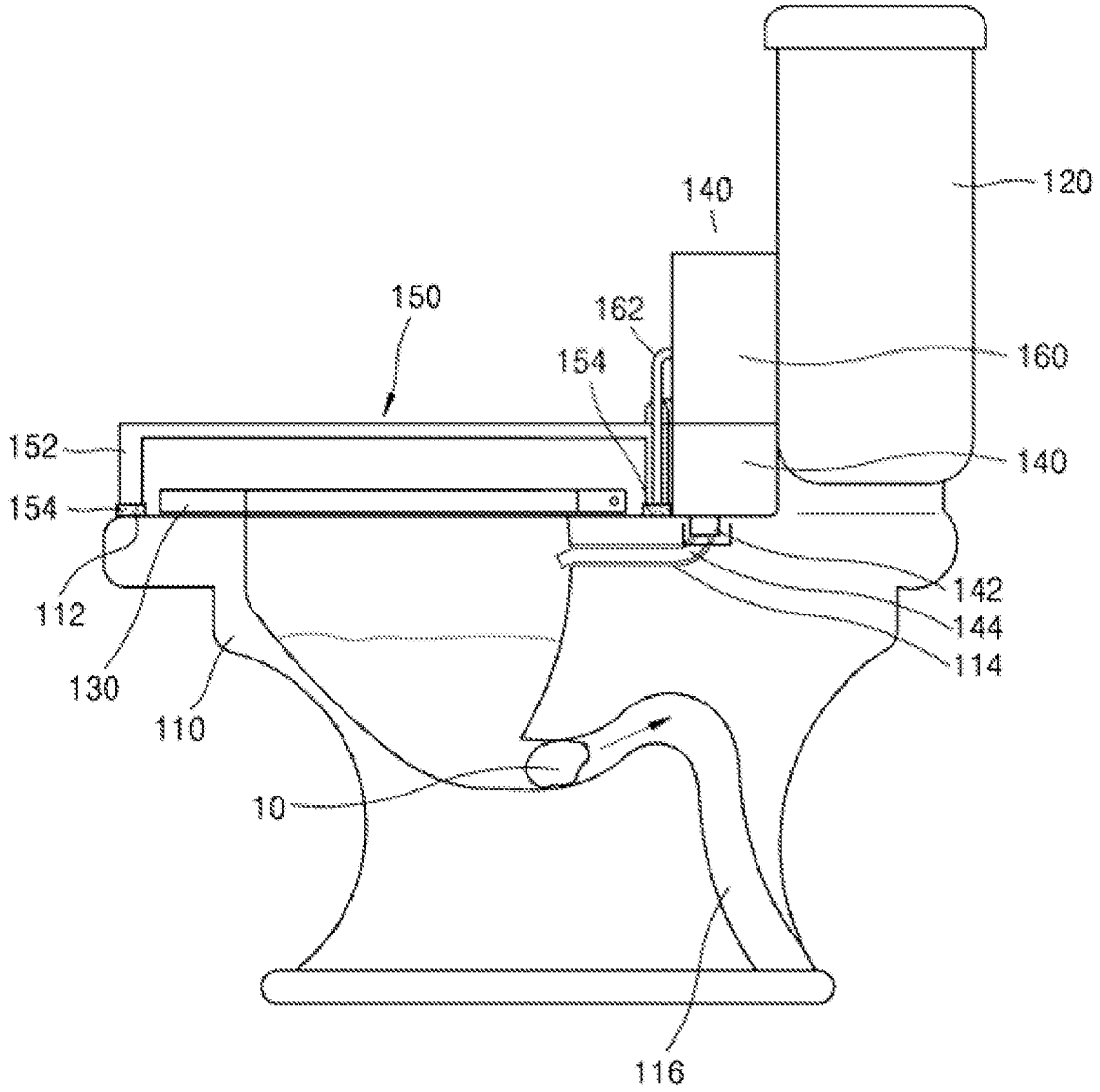

FIGS. 6 and 7 are cross-sectional views illustrating a toilet bowl according to a third example embodiment. In describing the example embodiment of FIGS. 6 and 7, content overlapping with that of FIGS. 2 to 5 is omitted.

FIG. 6 illustrates an example in which the flexible tube 170 is included and FIG. 7 illustrates an example in which the flexible tube 170 is not included. Referring to FIGS. 6 and 7, the toilet bowl may further include an air intake 160 configured to increase a pressing force between the upper edge 112 of the toilet body 110 and the sucker 154 and a suction pipe 162. The suction pipe 162 may communicate with the inside of the sucker 154 and the inside of the air intake 160. Therefore, the inside of the sucker 154 and the inside of the air intake 160 may communicate with each other.

The suction pipe 162 may insert through a through hole formed in the lateral surface 152 of the toilet cover 150 and thereby connect to the inside of the sucker 154. The suction pipe 162 may be made of a rubber material. Therefore, as the toilet cover 150 is fastened to a hinge and rotates, the suction pipe 162 may be bent or stretched. The air intake 160 may consume electrical energy and may reduce the internal pressure of the air intake 160. The air intake 160 may share power of a home bidet. When the internal pressure of the air intake 160 decreases, the air inside the sucker 154 may travel into the air intake 160 through the suction pipe 162 due to a pressure difference.

As the air inside the sucker 154 is absorbed by the air intake 160, a pressing force between the sucker 154 and the upper edge 112 of the toilet body 110 may increase. Therefore, although the gas with pressure is discharged into the water storage tank 120 of the toilet body 110, or the internal pressure of the water storage tank 120 increases according to an increase in the volume of the flexible tube 170, the toilet cover 150 may not be opened.

Figure 8:
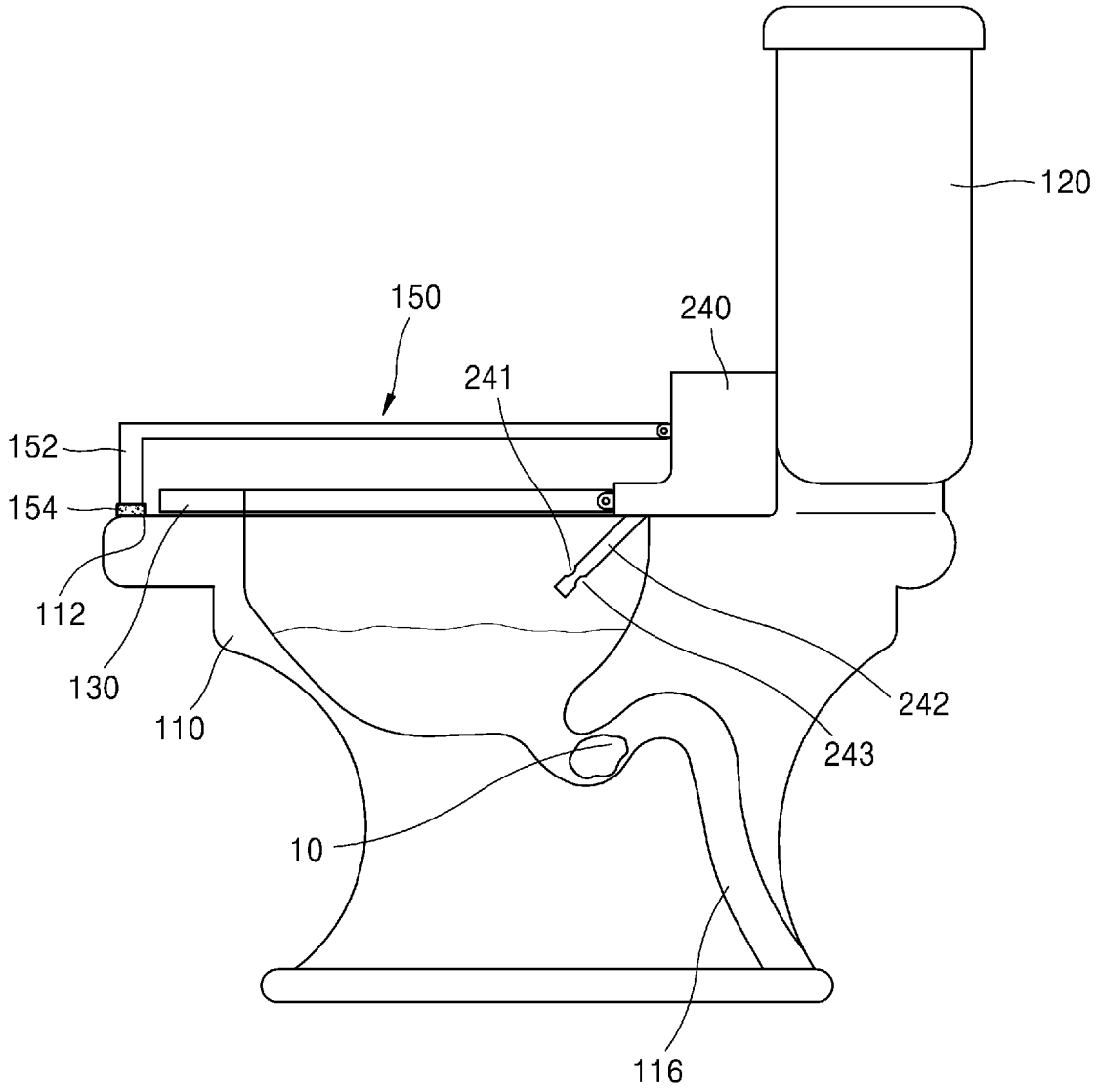
FIG. 8 is a cross-sectional view illustrating a toilet bowl according to a fourth example embodiment.

FIG. 8 is a cross-sectional view illustrating a toilet bowl according to a fourth example embodiment.

Referring to FIG. 8, the aforementioned cartridge may be built in a bidet 240 and may be implemented in an integral type. Two holes, for example, a first hole 241 and a second hole 243 may be formed in an outlet 242. Washing water may be discharged through the first hole 241 and gas with pressure may be discharged through the second hole 243. The cartridge and a washing water storage space may be provided in the bidet 240.

Figure 9:
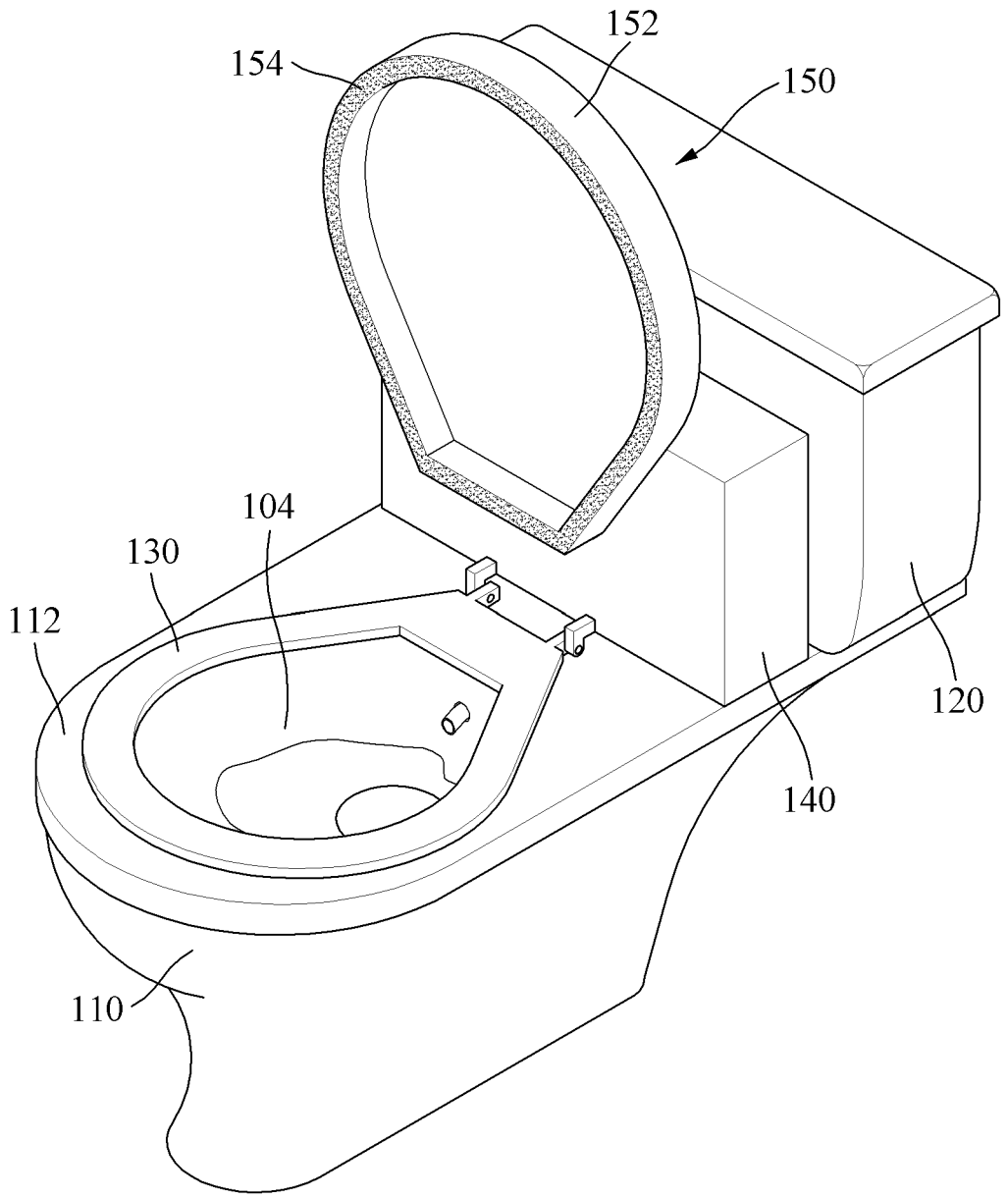
FIG. 9 is a cross-sectional view illustrating a cross-section of an outlet of FIG. 8.

FIG. 9 is a cross-sectional view illustrating a cross-section of the outlet 242 of FIG. 8. Referring to FIG. 9, the first hole 241 of the outlet 242 may communicate with a first flow path 241*a*, and the second hole 243 may communicate with a second flow path 243*a*. The first flow path 241*a* may be connected to the washing water storage tank provided in the bidet 240. The second flow path 243*a* may be connected to the cartridge provided in the bidet 240. The cartridge may store the gas with pressure. As another example, the cartridge may store sodium azide and, when discharging the gas with pressure, may operate an igniter and generate nitrogen gas from the sodium azide. The bidet 240 may discharge the washing water out of the first hole 241 through the first flow path 241*a* in a first operation mode. The bidet 240 may discharge the gas with pressure out of the second hole 242 through the second flow path 243*a* in a second operation mode. The second flow path 243*a* may correspond to the aforementioned nozzle.

Although FIG. 8 illustrates an example in which the outlet 242 includes two holes, for example, the first hole 241 and the second hole 243, it is provided as an example only. For example, only a single hole may be formed in the outlet 242. Also, the outlet 242 may discharge the washing water or discharge the gas with pressure based on an operation mode of the bidet 240.

Figure 10:
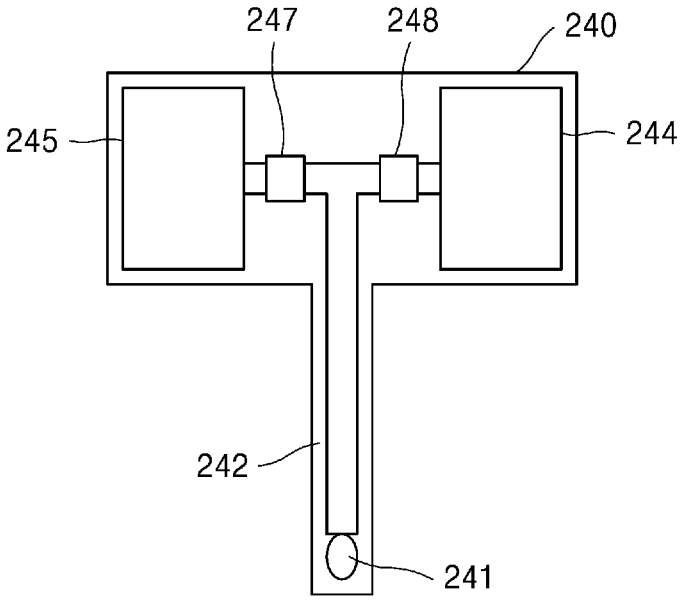
FIG. 10 is a cross-sectional view illustrating a cross-section of a bidet of FIG. 9.

FIG. 10 is a cross-sectional view illustrating a cross-section of the bidet 240.

Referring to FIG. 10, a washing water storage tank 244 and a cartridge 245 may be provided in the bidet 240. A flow path provided in the outlet 242 may be connected to the washing water storage tank 244 and a cartridge 245. The flow of fluid in the flow path may be adjusted by a first valve 248 and a second valve 247.

The bidet 240 may open the first valve 248 in a first operation mode. In the first operation model, the washing water stored in the washing water storage tank 244 may be discharged out of the first hole 241 of the outlet 242 through the flow path. The bidet 240 may open the second valve 247 in a second operation mode. In the second operation mode, the washing water stored in the cartridge 245 may be discharged out of the first hole 241 of the outlet 242 through the flow path.

Figure 11:
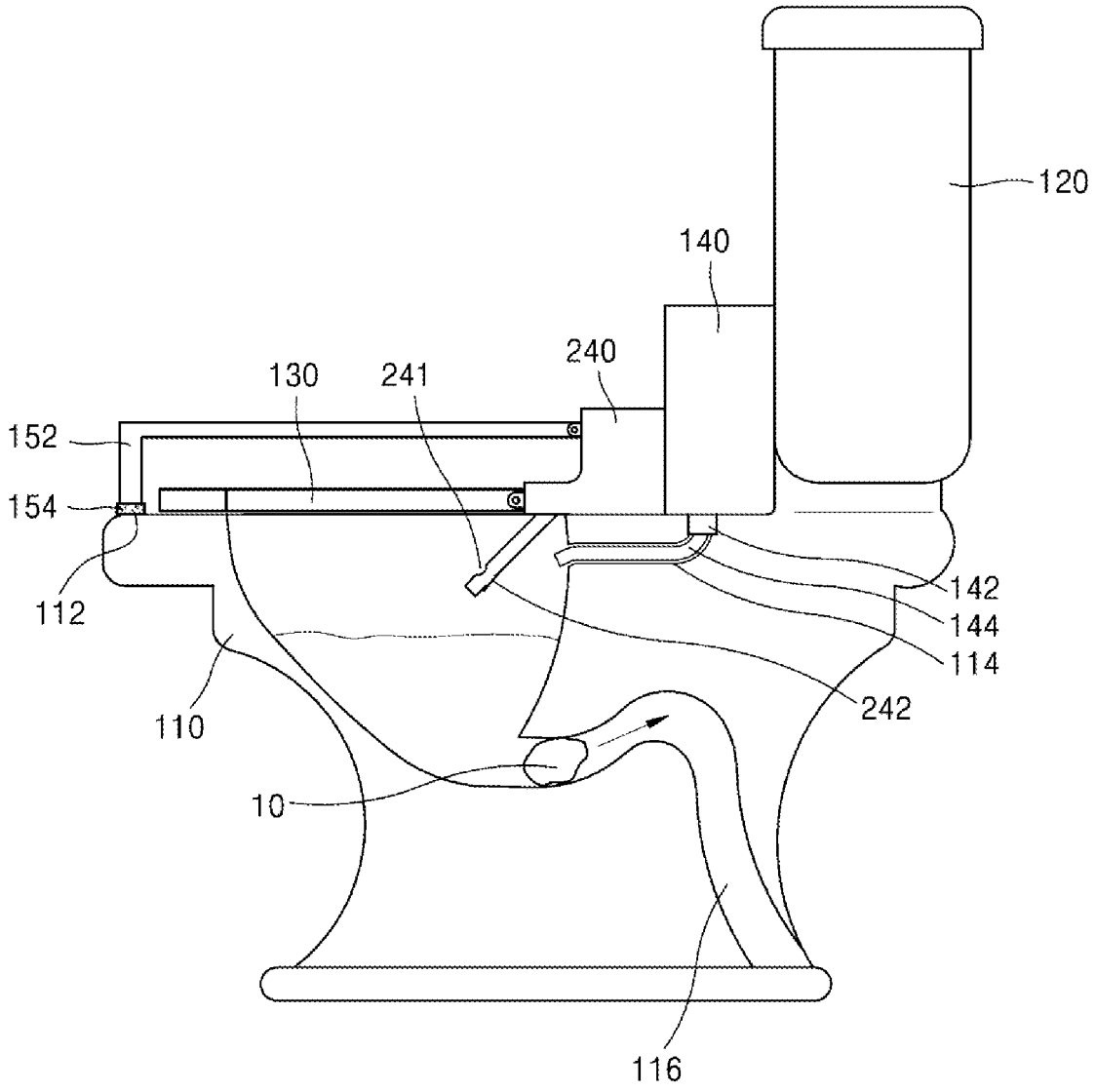
FIG. 11 is a cross-sectional view illustrating a toilet bowl according to a fifth example embodiment.

FIG. 11 is a cross-sectional view illustrating a toilet bowl according to a fifth example embodiment.

Referring to FIG. 11, the toilet bowl may include the bidet 240 and the cartridge 140. Dissimilar to the example embodiment of FIG. 8, the bidet 240 and the cartridge 140 may be separate from each other without being implemented in an integral type. The bidet 240 may discharge the washing water through the outlet 242. The cartridge 140 may discharge the gas with pressure through the nozzle 142. The nozzle 142 may insert into the toilet body 110.

Figure 12:
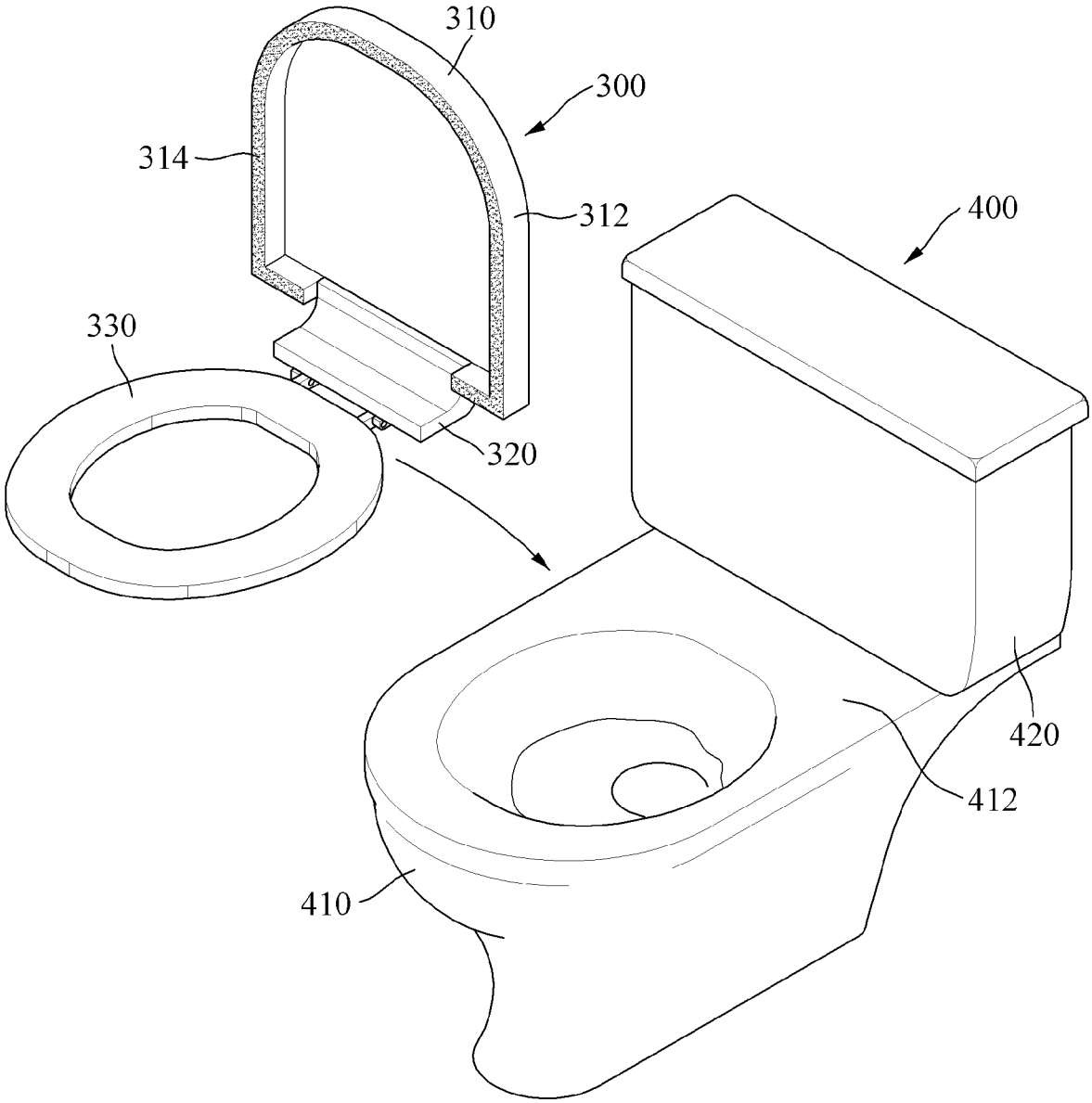
FIG. 12 illustrates a toilet clog removal device according to another example embodiment.

Although the example embodiments are described based on an example in which a device for removing clogging of a toilet is fastened to the toilet, it is provided as an example only. A device for removing clogging of a toilet may be separately provided from the toilet and may also be detachably provided to the toilet. FIG. 12 is a perspective view illustrating a toilet clog removal device 300 according to another example embodiment.

Referring to FIG. 12, the toilet clog removal device 300 may include a body 320 with a built-in cartridge, a seat 330 hinged to the front of the body 320, and a toilet cover 310 hinged to the body 320. A bidet configuration may be further built in the body 320. The toilet clog removal device 300 may be seated on a top of a toilet body 410 of a toilet bowl 400. The body 320 of the toilet clog removal device 300 may be seated in front of a water storage tank 420 of the toilet bowl 400.

The toilet cover 310 may include a top surface and a side surface 312 configured to support the top surface. A sucker 314 may be provided below the side surface 312. The sucker 314 may be pressed against an upper edge 412 of the toilet body 410. A water storage space of the toilet body 410 may be opened or closed by the toilet cover 310. When the sucker 314 is pressed against the upper edge 412 of the toilet body 410, the water storage space of the toilet body 410 may be sealed.

Figure 13:
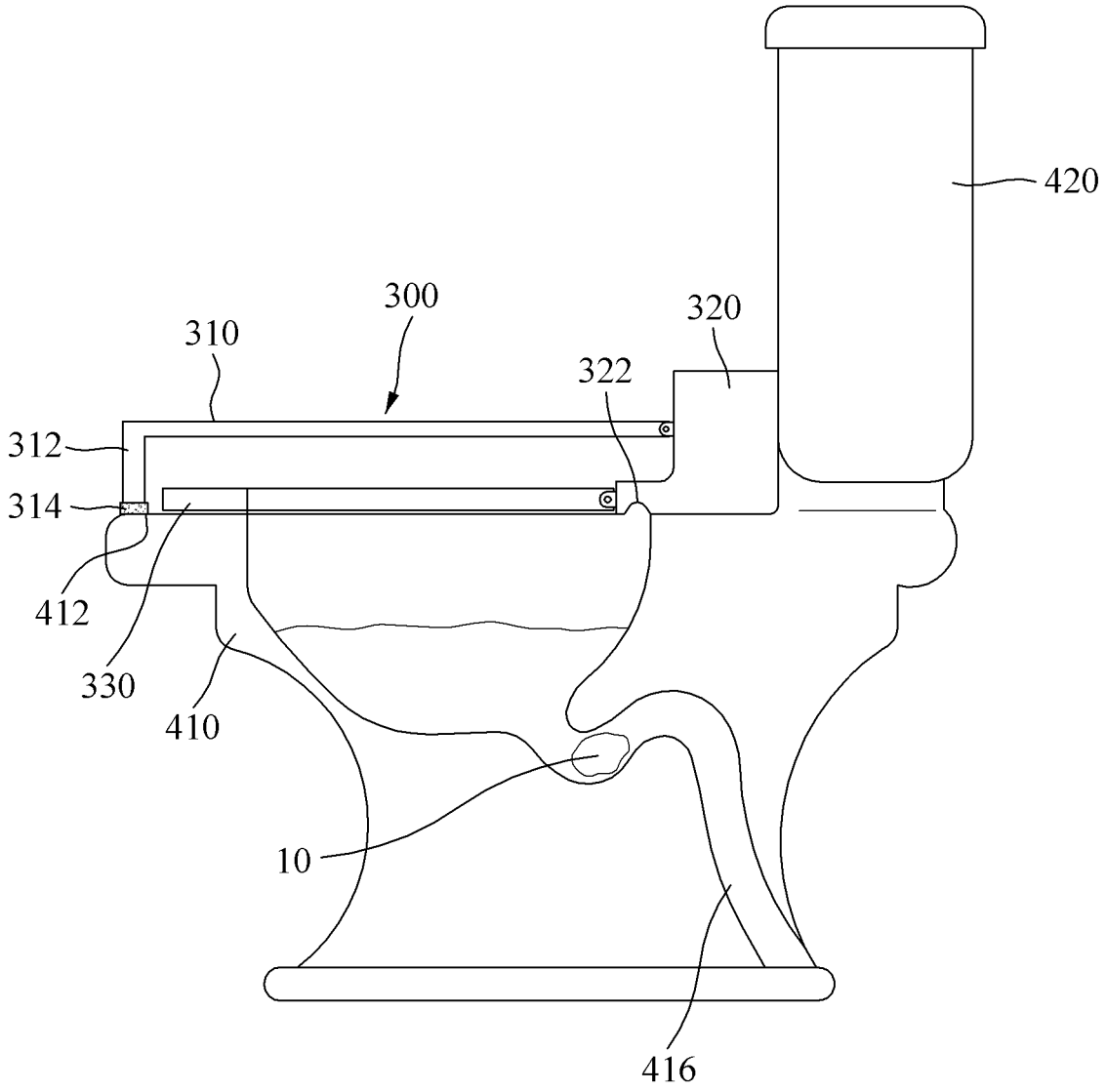
FIG. 13 is a cross-sectional view illustrating a state in which the toilet clog removal device of FIG. 12 is installed in a toilet bowl.

FIG. 13 is a cross-sectional view illustrating a state in which the toilet clog removal device 300 of FIG. 12 is installed in the toilet bowl 400.

Referring to FIG. 13, an outlet 322 may be formed at one end of the body 320 of the toilet clog removal device 300. The gas with pressure generated or stored in the cartridge built in the body 320 may be discharged into the water storage space through the outlet 322. The cartridge may discharge a large amount of nitrogen gas instantaneously. When the gas with pressure is discharged through the outlet 322, pressure of the water storage space may increase. While the gas with pressure is being discharged through the outlet 322, the water storage space may be maintained in a sealed state by the toilet cover 310.

Figure 14:
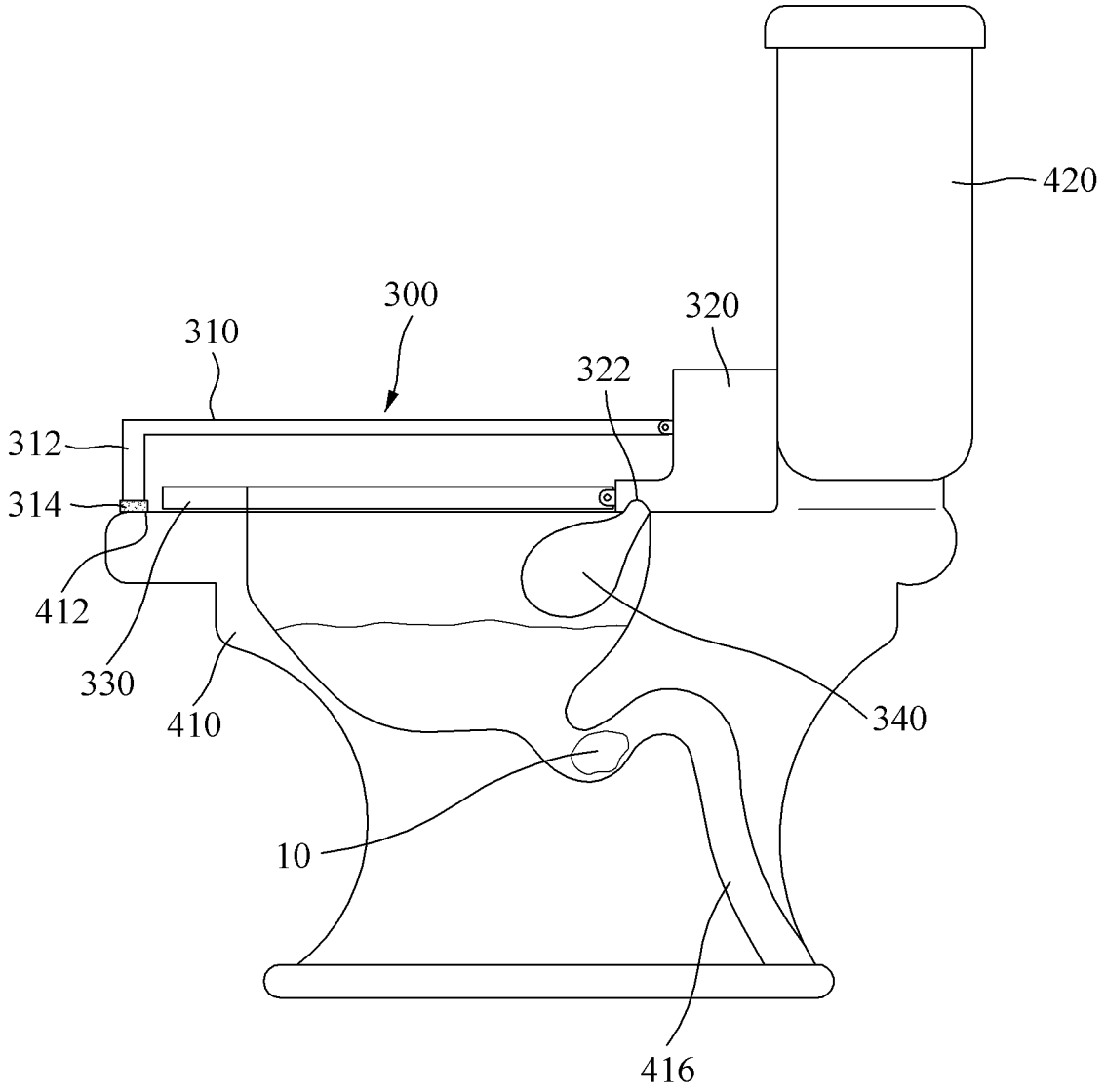
FIG. 14 is a cross-sectional view illustrating a modification example of the toilet clog removal device of FIG. 13.

FIG. 14 is a cross-sectional view illustrating a modification example of the toilet clog removal device 300 of FIG. 13.

Referring to FIG. 14, the toilet clog removal device 300 may include a flexible tube 340 connected to the outlet 322. When the cartridge discharges the gas with pressure through the outlet 322, the discharged gas with pressure may increase volume of the flexible tube 340. When the volume of the flexible tube 340 increases in a state in which the water storage tank is sealed, the pressure of the water storage tank may increase. The increased pressure may generate a force of pushing the water stored in the water storage tank into a drainage channel 416. Clogging of the drainage channel 416 may be removed as the foreign substance 10 present in the drainage channel 416 is pushed out by this pushing force.

A toilet bowl according to example embodiments is described with reference to FIGS. 1 to 14. According to at least one example embodiment, it is possible to remove clogging of a toilet by discharging gas with pressure into a water storage tank of a toilet body. According to at least one example embodiment, it is possible to maintain an inside of a water storage tank in a sealed state while discharging gas with pressure using a toilet cover that includes a lateral surface and a sucker. According to at least one example embodiment, it is possible to discharge gas with pressure into a water storage tank with a strong pressure using sodium azide. According to at least one example embodiment, it is possible to effectively increase the pressure of the water storage tank and to prevent splashing of water and dirt by connecting a flexible tube to the nozzle.

While the present disclosure is described with reference to specific matters such as components, some example embodiments, and drawings, they are merely provided to help general understanding of the disclosure and this disclosure is not limited to the example embodiments. It will be apparent to those skilled in the art that various alternations and modifications in forms and details may be made from the disclosure.

Therefore, the scope of this disclosure is not defined by the example embodiments, but by the claims and their equivalents, and all variations within the scope of the claims and their equivalents are to be construed as being included in the disclosure.

What is claimed is:

1. A toilet clog removal device installed in a toilet bowl, the toilet clog removal device comprising:

a cartridge provided in an upper portion of a toilet body and configured to generate or store gas with pressure;

an outlet configured to allow the gas with pressure generated or stored in the cartridge to be discharged into a water storage space of the toilet body; and a toilet cover hinged to the cartridge and configured to open and close above a toilet seat and the toilet body, wherein the toilet cover is configured to seal the water storage space, the cartridge stores a compound for generating the gas with pressure inside and, when the compound decomposes by igniting an igniter, the gas with pressure is generated and discharged from the cartridge.

2. The toilet clog removal device of claim 1, wherein the toilet cover is configured to protrude from an edge and a sucker configured to attach to the edge of the toilet cover, the sucker allows the water storage space to be sealed when the toilet cover is closed and pressed against an upper edge of the toilet body.

3. The toilet clog removal device of claim 1, wherein a circumferential length of a lateral wall of the toilet cover is greater than that of the toilet seat.

4. The toilet clog removal device of claim 3, further comprising:

a flexible tube configured to connect at an end of the outlet and of which volume varies based on an amount of gas with pressure discharged from the nozzle.

5. The toilet clog removal device of claim 4, further comprising:

a gas intake configured to increase a pressing force between a sucker and an upper edge of the toilet body by inhaling the gas inside the sucker through a suction pipe that communicates with the inside of the sucker.

6. The toilet clog removal device of claim 1, wherein the cartridge stores sodium azide inside and, when the compound decomposes by igniting the igniter, the gas with pressure is generated and discharged from the cartridge.

7. A toilet bowl comprising:

a toilet body having a water storage space of which an upper portion is open and of which a central portion is recessed to accommodate water;

a water storage tank configured to supply water to the toilet body;

a toilet seat rotatably hinged to an upper portion of the toilet body;

a cartridge provided between the toilet body and the water storage tank and configured to generate or store gas with pressure;

a nozzle configured to allow the gas with pressure stored in the cartridge to be discharged into the water storage space of the toilet body; and a toilet cover hinged to the cartridge and configured to open and close above the toilet seat and the toilet body, wherein the toilet cover is configured to seal the water storage space, the cartridge stores a compound for generating the gas with pressure inside and, when the compound decomposes by igniting an igniter, the gas with pressure is generated and discharged from the cartridge.

8. The toilet bowl of claim 7, further comprising:

a bidet configured to couple with the upper portion of the toilet body, wherein the cartridge is built in the bidet and the nozzle is built in an outlet of the bidet.

* * * * *